US006848279B2

(12) United States Patent
Fehrenbacher

(10) Patent No.: US 6,848,279 B2
(45) Date of Patent: Feb. 1, 2005

(54) SYSTEM ELEMENT

(75) Inventor: Eckhard Fehrenbacher, Bondorf (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/255,678

(22) Filed: Sep. 27, 2002

(65) Prior Publication Data

US 2003/0084688 A1 May 8, 2003

(30) Foreign Application Priority Data

Sep. 28, 2001 (DE) ..... 101 48 196

(51) Int. Cl.[7] ..... D04B 15/06
(52) U.S. Cl. ..... 66/104; 66/123
(58) Field of Search ..... 66/8, 218, 219, 66/220, 221, 104, 106, 113, 123

(56) References Cited

U.S. PATENT DOCUMENTS 5,666,826 A 9/1997 Mista
5,775,135 A * 7/1998 Shibata et al. ..... 66/219
6,145,349 A 11/2000 Sciacca
6,484,541 B1 * 11/2002 Haag ..... 66/104

FOREIGN PATENT DOCUMENTS

| | | |
|---|---|---|
| DE | 75 13 746 U | 9/1975 |
| EP | 0 814 187 A2 | 12/1997 |
| EP | 10077557 | 3/1998 |
| GB | 1 525 629 | 9/1978 |

* cited by examiner

*Primary Examiner*—Danny Worrell
(74) *Attorney, Agent, or Firm*—Venable LLP; NOrman N. Kunitz

(57) ABSTRACT

A selection element (16) is movably seated in a system element, for example a needle (1). As an assembly aid for temporary fixation, a material-to-material connection in the form of an adhesive, lacquer, a laser weld spot or a thin strip of material is provided on at least one connecting point (34), which breaks or is dissolved in the course of first use.

17 Claims, 5 Drawing Sheets

SYSTEM ELEMENT

FIELD OF THE INVENTION

The invention relates to a system element, in particular for stitch-forming machines, having a system element body and a selection element, which are connected with each other by means of a material-to-material contact.

BACKGROUND OF THE INVENTION

Knitting machines have knitting systems, of which several elements, so-called system elements, are a part. Here, system elements are considered to be all elements of a stitch-forming system, in particular the movably seated elements thereof. Elements which are to be moved in a translatory way and are concerned with stitch formation in particular are parts of these, as well as other elements which generate a desired structure, such as cutting needles and the like. The invention can be employed in connection with knitting machine needles in particular. Selection elements, jack selectors, coupling elements, plates, springs, etc. are understood to be system elements besides needles.

System elements are known in connection with stitch-forming machines, such as needles or other knitting tools, for example, which are seated in a longitudinally displaceable manner in the needle groove of a needle cylinder or of a dial. A so-called cam with a cam curve is used for driving the system elements. In order to be able to exactly control system elements, for example needles, the latter are frequently provided or connected with so-called selection elements, which have a butt which can be brought into and out of contact with the cam curve. The selection element transfers its linear movements to the needle or the knitting tool.

In the process of the initial equipping of knitting machines or other stitch-forming machines it is required to insert the knitting tools or systems elements, which exist in large numbers, into their guide grooves. This insertion requires a large amount of dexterity, in particular in those cases where a selection element is part of the system element, i.e. if two or more parts which cooperate, but are not fixedly connected with each other, are inserted into the knitting machine, for example into the needle groove.

The same difficult task arises in connection with the maintenance of knitting machines or other stitch-forming machines. There, too, is it necessary to remove the knitting tools or other system elements, which exist in large numbers, from their guide grooves and to reinsert them or to replace them with fresh system elements. If a separate selection element is part of the system element, the insertion of the system element and the selection element is a task requiring a large degree of dexterity.

OBJECT AND SUMMARY OF THE INVENTION

It is the object of the invention to improve the ability to manipulate such system elements.

This object is attained according to the invention by a system element 1 for stitch-forming machines, having: a system element body that has a section intended for being received in a system element groove and has two flat sides located opposite each other: a selection element that is equipped to impart a movement to the system element body, wherein it can be put into and out of engagement with a drive mechanism via a control movement, and that is connected at least in the direction of movement with the system element body; and, at least one connecting point provided in the deliver state of the system element, making a material-to-material connection between the selection element and the system element body.

The system element of the invention has a selection element which, in regard to the reciprocal movement of the system element, is connected with the base body of the system element. Furthermore, it should be movably seated, as least in the operational state, in such a way that it can be brought into and out of engagement with a drive mechanism. However, in the delivered state the selection element is fixedly connected with the system element. A material-to-material contact between the selection element and the system element body is used for the connection. In this way the system element consisting of the system element body and the selection element constitutes a manipulable unit, which can be inserted as such into the guide groove and can also be removed from it, as long as it has not yet been in operation. In this way it is assured that in the course of assembly, i.e. the insertion of the system element into the guide groove, the base body and the selection element do not part. The assembly is considerably eased and assembly errors are avoided.

As soon as the machine, newly equipped with the system elements, is put into operation for the first time and the respective selection element performs a control movement for the first time, the connecting point tears or breaks apart. The latter is of such dimensions that it breaks or tears without noticeably impeding the control movement, and in particular without hampering the needle body or the selection element. In this way the selection element which, in the delivered state of the system element was fixedly connected with the system element body, is separated from the system element body in the course of the first employment. Thus, the connecting point with a connection between the material of the selection element with the system element body simultaneously constitutes a separating point.

The selection element is preferably pivotably seated on the system element body and is biased by means of a spring means, for example in one direction, against a detent. The connecting point can be arranged on the respective detent, for example. A further connecting point should be advantageously provided on the oppositely located end of the selection element. If the elongated selection element is connected at its two oppositely located ends by means of material-to-material connections with the respective system element body, an element is obtained which can be handled in a particularly rugged manner and therefore can be assembled in a simple way.

The connecting point, or connecting points, are preferably arranged in areas of the system element which perform a considerable relative movement in respect to each other when a control movement is performed by the selection element. The connecting point is at least advantageously selected in such a way that in the course of the performing a control movement the lift, or the size of the mutual relative movement between the selection element and the system element body, is greater than an elastic reserve of the material-to-material connection. The tearing, or breaking, of the latter in the course of performing the first control movement is assured by means of this.

After the connection between the selection element and the system element base body has been ruptured, the control movement can be performed without hindrance. No differences then exist regarding functioning in comparison with system elements known so far.

The material-to-material connection can be constituted by means of an adhesive or a lacquer, i.e. a non-metallic connection. The adhesive or lacquer are preferably selected in such a way that they lose their stickiness after drying or curing and no longer have an adhesive effect, so that the break surfaces of the lacquer or adhesive being created in this manner do not adhere to each other when they again come into contact with each other. In this way the function of the system elements which is customary following their first use is assured.

It is possible to employ adhesives or lacquers which are generally soluble in machine lubricant, or are generally insoluble. Soluble lacquers have the advantage that residues still existing on the system elements are removed by the machine lubricant. On the other hand, insoluble lacquers have the advantage of not altering the machine lubricants. However, it is also possible to employ adhesives or lacquers which are soluble in specific machine lubricants, but are insoluble in others.

Moreover, the connecting point can be constituted by a metallic contact, for example as a soldered or welded connection, which is more likely designed as a tack. For example, a small laser spot weld can provide the desired temporary tearable connection. It is moreover possible to provide the one-piece connection of the selection element with the system element body by means of a weak bridge of material. This is sensible in exceptional cases if the selection element and the system element are produced as one piece.

Advantageous embodiments of the invention ensue from the drawings, the description or the dependent claims.

Exemplary embodiments of the invention are illustrated in the drawings.

DETAILED DESCRIPTION OF THE PREFERRED EMBODIMENTS

Figure 1:
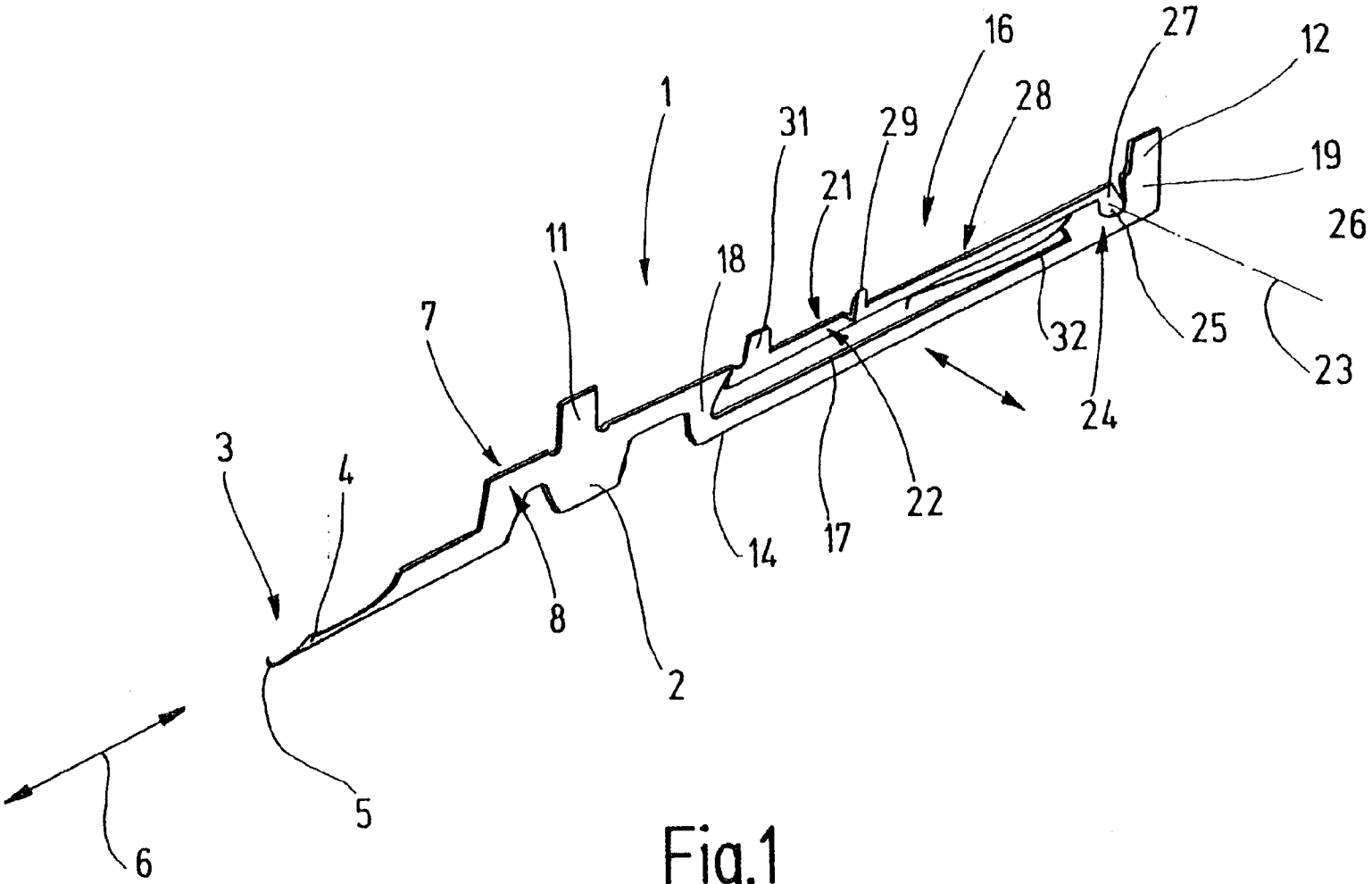
FIG. 1 represents a knitting machine needle n a perspective representation.

A system element will be represented in what follows by means of the example of a needle 1, such as is employed in knitting machines. The needle 1 illustrated in FIG. 1 is also called a selection needle. It has a base body 2, which supports a tip 3 at one end. The tip 3 is used as a stitch-forming element and has a pivotably seated tongue 4 and a hook 5 located at the end.

During its use the needle 1 is seated and is movable back and forth in a direction of movement symbolized by an arrow 6 in FIG. 1. The needle 1 is housed in a guide groove for this purpose, in which it is guided on its oppositely located flat sides 7, 8.

Initially, for being driven, the needle 1 has one or several butts 11, 12, which extend away from the side located opposite its needle back 14.

In addition, for controlled driving the needle has a selection element 16, which is used to switch the needle into an active or passive mode for a defined movement, i.e. to select or not to select. At least with the embodiment of the needle 1 represented in FIG. 1, the selection element 16 is received in a recesses 17 of the needle body, which is open in the direction of its side facing away from the needle back 14, and which is limited at the front and back in relation to the movement direction of the needle 1 by respective bars 18, 19. The selection element 16 is constituted by an elongated rod-shaped section, whose lateral flanks 21, 22 are aligned with the flat sides 7, 8. Thus, the selection element 16 has the same thickness as the base body 2. On its end remote from the tip 3, the selection element 16 is pivotably seated around a pivot axis 23. The latter is defined by a hinge 24, part of which are a disk-shaped head 25 provided on the selection element 16, and a corresponding seating opening 26. The latter extends transversely through the base body 2 and is open toward the flat sides 7, 8. Furthermore, its circumferential edge is interrupted open and a connecting strip 27 extends through the gap. The connecting strip 27 connects the head 25 with a longitudinal strip 28 of the selection element 16.

On its side remote from the needle back 14, the longitudinal strip 28 is provided with a selection butt 29, which extends at right angles away from the longitudinal strip 28 and is used for pivoting the selection element 16. In addition, the longitudinal strip 28 supports at least one other butt 31, which extends away from the longitudinal strip 28 like a flag. It can be activated or made passive by pivoting the selection element 16, i.e. it can be used as a controlled drive mechanism.

A leaf spring 32 is arranged in the recess 17 of the base body 2 below the selection element 16 which, for example, is formed as one piece on the base body 2 or, as in the embodiment in accordance with FIG. 5, has been inserted into a corresponding slit 33 and fastened therein.

Figure 3:
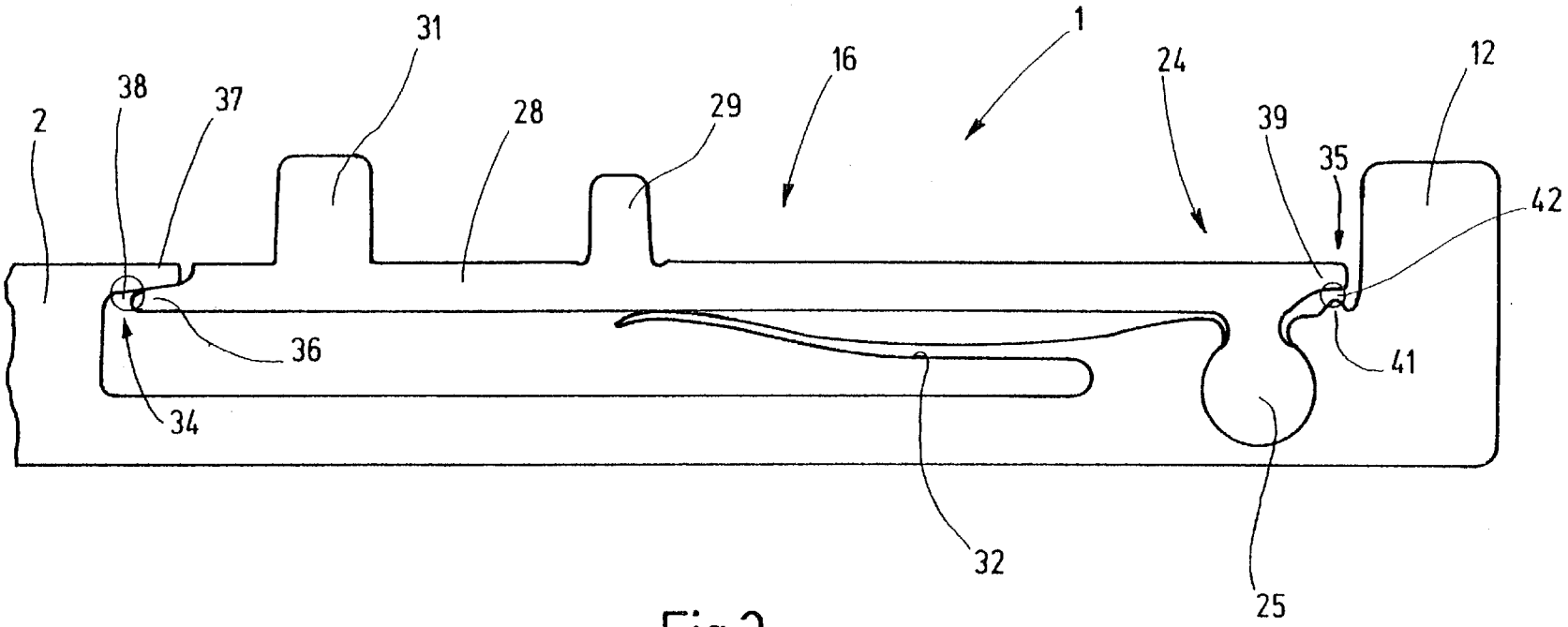
FIG. 3 is an altered embodiment of the needle of the invention in a lateral view.

In the delivered state, i.e. prior to the first use of the needle 1, to provisionally locate the selection element 16 in the recess 17 the selection element is connected with the base body 2 at connecting points 34, 35 in the recess 17 before the needle 1 is installed in the guide groove. For this purpose a small amount of an adhesive 38, which forms a material-to-material contact between a protrusion 36 and a projection 37, has been applied, for example, between the protrusion 36 provided at the end of the longitudinal strip 28, and the projection 37 formed on the base body 2, behind which the protrusion 36 extends. Correspondingly it is possible to provide a protrusion 39 on the oppositely located end of the selection element 16, which is arranged at a slight distance from an area 41 of the base body. A nip provided there can also be bridged by a small amount of an adhesive 42, so that a material-to-material contact between the selection element 16 and the base body 2 is also created at this point. The adhesive 38, 42 can be respectively arranged in an existing gap or, as illustrated in FIG. 3 at the connecting point 35, it can respectively bridge an existing gap (nip) as a small dab. Screw retention lacquer, for example, is used as the adhesive. Alkyd resin lacquers, chlorinated rubber lacquers, epoxy resin lacquers, acrylate resin lacquers, cellulose nitrate lacquers, polyester lacquers, polyurethane lacquers, combination lacquers made of cellulose nitrate and alkyd resins, as well as synthetic resin lacquers (basis: phenolic resins, amine resins, melamine resins, polyvinyl resins) can be employed. Drying, or curing accelerators can be added to the lacquers or adhesives, which are used for rapid drying by means of hot air, ion or electron radiation, or UV exposure. Curing can take place by means of poly addition, poly condensation or polymerization. Moreover, drying lacquers can be used which become solid by airing and evaporation of solvents.

The needle 1 so far described is used in the following manner:

In the course of production, the selection element 16 is connected with the base body 2 by means of lacquer or an adhesive 38, 42. After this connection has hardened (solidified), the needles are packaged and delivered. In this condition they come into the possession of the operator or assembler, who is to insert them into corresponding guide grooves of a machine. In the process he can manipulate the entire needle as a whole as a rugged part without having to fear that the selection element 16 becomes separated from the base body 2. Thus, he needs neither a special tool nor particular dexterity for manipulation.

As soon as all needles have been inserted into their guide grooves and the machine has been closed, the butts 11, 12, 31, as well as the selection butt 29 come into contact with the corresponding cam element of the machine. For example, the selection element 16 is pushed for the first time into the recess 17 by means of the selection butt 29, i.e. it is pivoted. In the process the adhesive 38 at the connecting point 34, as well as the adhesive 38 at the connecting point 35, tear or break. Thus, both connecting points 34, 35 are opened by breaking, i.e. the destruction of the adhesive connection. However, the strength of the latter is so little that neither the longitudinal strip 28, nor the protrusions 36, 39 are deformed. Therefore the needle 1 is fully capable of functioning and in its further operation does not differ in any respect from a needle which had been installed in the guide groove in the already unsecured state.

When using an adhesive or lacquer which dissolves in machine lubricant, the adhesive connection is undone after the insertion of the system elements 1 (needles) without a mechanical stress of the selection butt 29. The needles are then completely capable of functioning.

Figure 2:
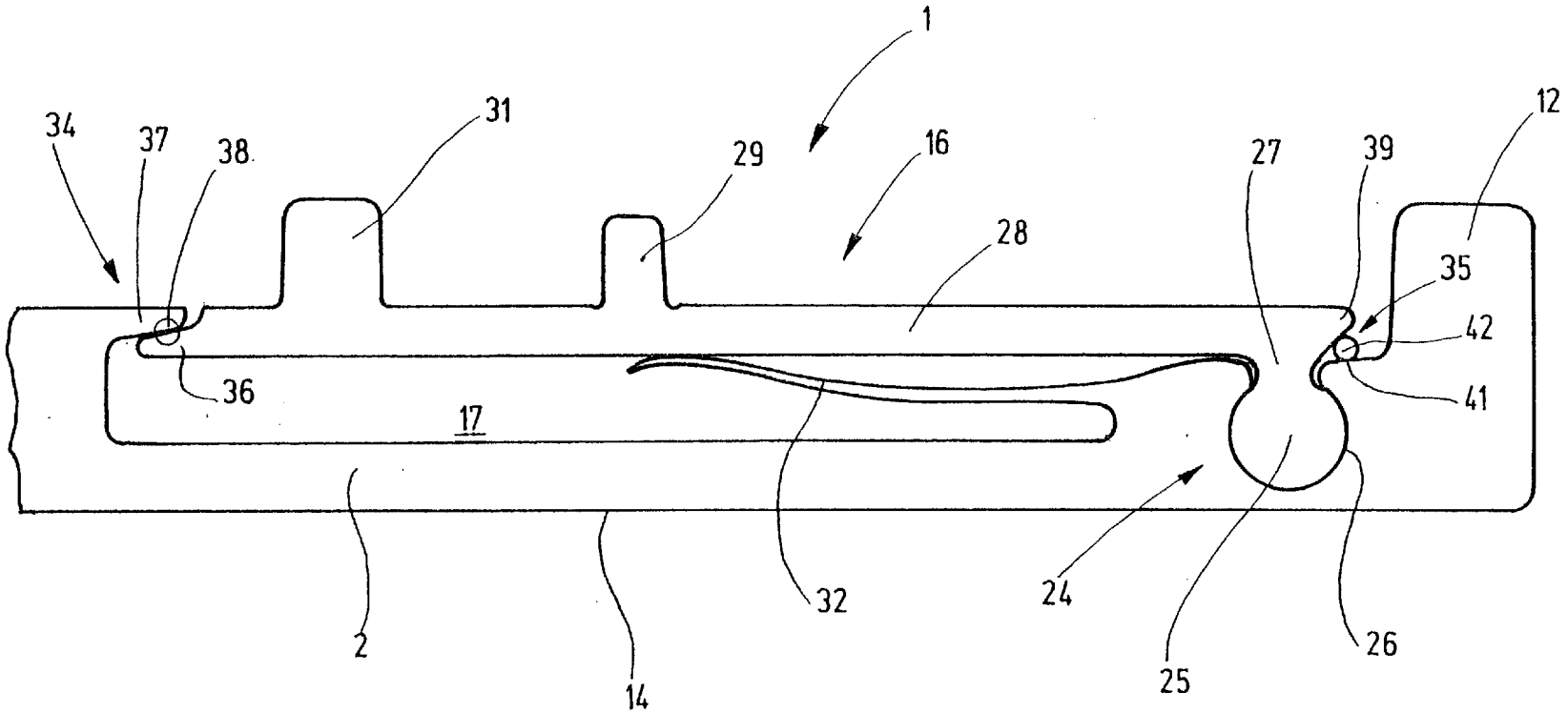
FIG. 2 shows the knitting machine needle of FIG. 1 in a partial lateral view on a different scale.

An altered embodiment of the invention is illustrated in FIG. 3. This one differs from the embodiment described above in connection with FIG. 2 in that the protrusion 39 has been extended, while the area 41 has been embodied as a small projection. A parallel gap is formed between the area 41 and the protrusion 39, which maintains an adhesive dab 42 well in place because of the tapering contour of the area 41. By means of this the adhesive is prevented from entering into the hinge 24.

Figure 4:
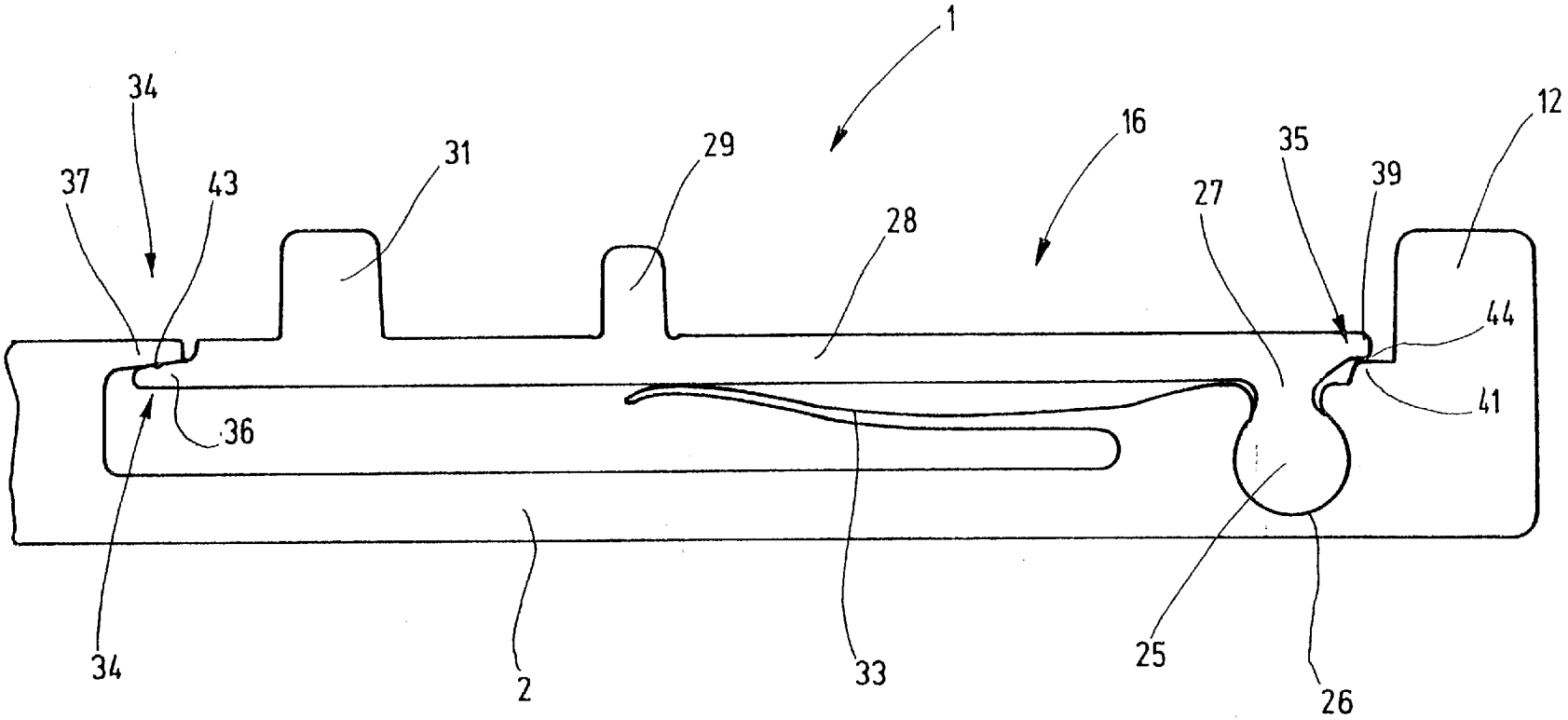
FIG. 4 represents a further embodiment of the knitting machine needle in a lateral view.

A further embodiment of the invention is illustrated in connection with FIG. 4. Here, laser weld spots 43, 44 formed on the protrusion 36 and the protrusion 39 are each used as connecting points 34, 35. In this case the laser weld spots 43, 44 are of such dimensions that they cannot withstand the actuating forces of the selection element 16 in any way, but instead tear open easily during the first actuation of the selection element 16.

Figure 5:
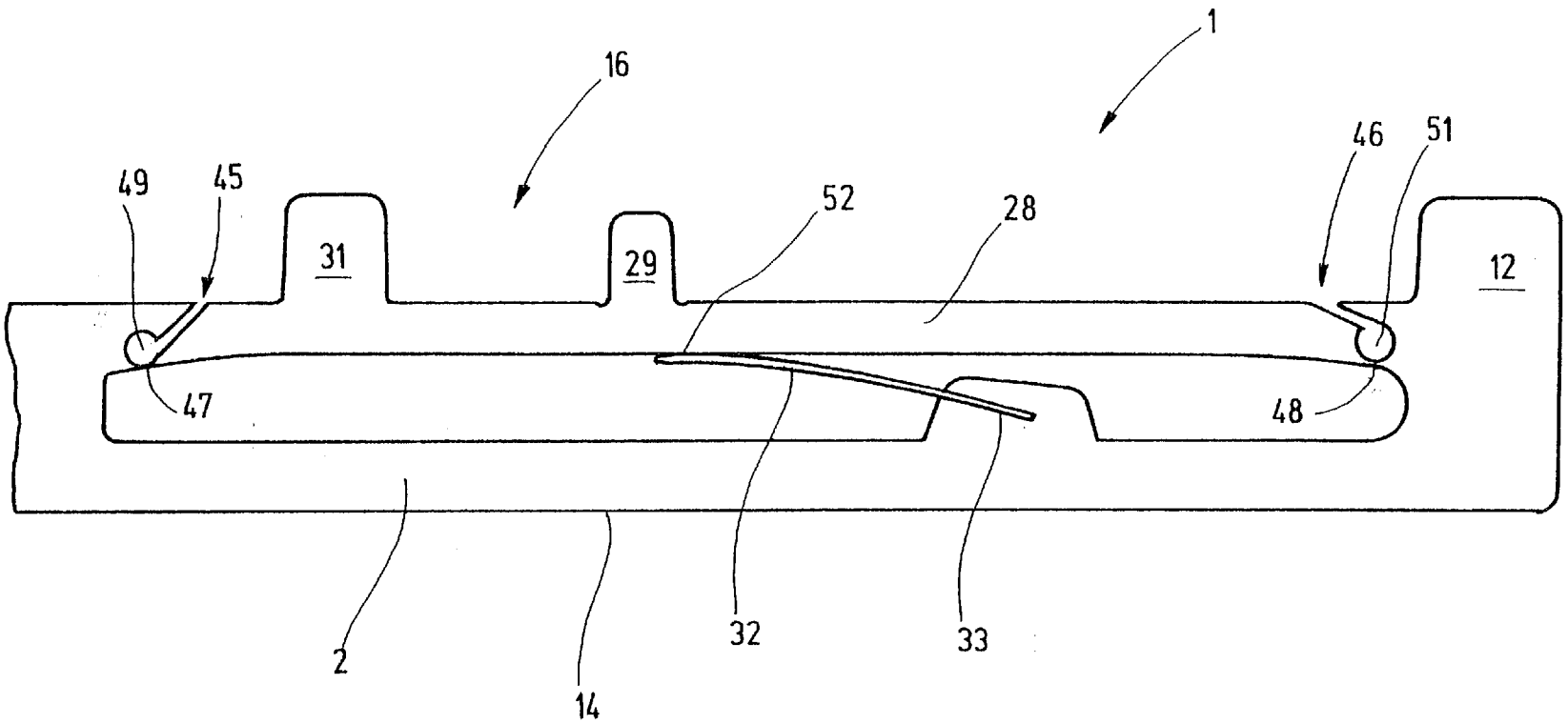
FIG. 5 shows a further embodiment of the needle with the selection element and the needle body produced in one piece.

A further embodiment is illustrated in FIG. 5. Here, the base body 2 and the selection element 16 are embodied as a single part. Slits 45, 46 are provided at the ends of the selection element 16 for separating the elements from each other, each of which separates the selection element 16 from the needle body 2, except for a very thin remaining strip 47, 48. In this case the strips 47, 48 are so weak that they can only be used for temporarily maintaining the selection element 16 on the base body, and cannot resist the actuating forces of the selection element 16. If needed, the slits 45, 46 can terminate in a bore 49, 51 in order to better fix the thickness of the filigreed strip 47, 48. With this embodiment the leaf spring 32 has been inserted as a separate element into the slit 33 and is adapted to securely brace the selection element 16 against the needle body 2 after the strips 47, 48 have been broken. The slits 45, 46 are arranged obliquely in respect to the needle back 14 for this purpose.

The free end of the leaf spring 32 can be connected with the longitudinal strip 28 at a weld spot 52. This weld spot 52 is not intended as a predetermined breaking point like the strips 47, 48, but as a permanent connection.

A selection element 16 is movably seated in a system element, for example a needle 1. As an assembly aid for temporary fixation, a material-to-material connection in the form of an adhesive, lacquer, a laser weld spot or a thin strip of material is provided on at least one connecting point 34, which breaks or is dissolved in the course of first use.

LIST OF REFERENCE SYMBOLS

1 Needle
2 Base body
3 Tip
4 Tongue
5 Hook
6 Arrow
7, 8 Flat sides
11, 12 Butts
14 Needle back
16 Selection element
17 Recess
18, 19 Strip
21, 22 Flanks
23 Pivot axis
24 Hinge
25 Head
26 Seating opening
27 Connecting strip
28 Longitudinal strip
29 Selection butt
31 Butt
32 Leaf spring
33 Slit
34, 35 Connecting points
36 Protrusion
37 Projection
38 Adhesive
39 Protrusion
41 Area
42 Adhesive
43, 44 Laser weld spot
45, 46 Slit
47, 48 Strip
49, 51 Bore
52 Weld spot

What is claimed is:

1. A system element or stitch-forming machines, having: a system element body, which has a section intend d for being received in a system element groove and has two flat sides located opposite each other, a selection element, which is equipped to impart a movement to the system element body, wherein it can be put into and out of engagement with a drive mechanism by a control movement, and which is connected at least in the direction of movement with the system element body, and at least one breakable connecting point provided in an initial delivery state of the system element, making a material-to-material connection between the selection element and the system element body to prevent separation of the selection element from the system element body prior to installation in a system element groove.

2. The system element in accordance with the claim 1, wherein the selection element is seated on the system element body, and is pivotable around a pivot axis, which is arranged at right angles with respect to the flat sides.

3. The system element in accordance with claim 2, wherein the selection element is a selection element which is separate from the system element body and is connected to the system element body via hinge means, whose hinge axis is the pivot axis.

4. The system element in accordance with claim 1, wherein spring means are assigned to the selection element, which resiliently bias the selection element in a pivot direction.

5. The system element in accordance with claim 1, wherein the selection element is resiliently biased against a detent.

6. The system element in accordance with claim 1, wherein the selection element is an elongated selection element, which is arranged in a spacious recess of the system element body and is movably seated, and whose thickness corresponds to the thickness of the system element body.

7. The system element in accordance with claim 1, wherein a predetermined breaking point is fixed at the connecting point.

8. The system element in accordance with claim 1, wherein the connection at the connecting point is of such a strength that it tears or breaks when the first actuating movement is performed.

9. The system element in accordance with claim 1, wherein an adhesive is arranged at the connecting point, which constitutes a breakable connection between the system element body and the selection element after it has dried or cured.

10. The system element in accordance with claim 1, wherein lacquer is arranged at the connecting point, which makes a breakable connection between the system element body and the selection element after it has dried or cured.

11. The system element in accordance with claim 10, wherein the adhesive or the lacquer can be dissolved in machine lubricant.

12. The system element in accordance with claim 10, wherein the adhesive or the lacquer cannot be dissolved in machine lubricant.

13. The system element in accordance with claim 1, wherein a soldered or welded connection is made at the connecting point, which constitutes a breakable connection between the system element body and the selection element.

14. The system element in accordance with claim 13, wherein the welded connection is a laser weld spot.

15. The system element in accordance with claim 1, wherein the system element body and the selection element are initially embodied as one piece.

16. The system element in accordance with claim 9, wherein the adhesive or the lacquer can be dissolve in machine lubricant.

17. The system element in accordance with claim 9, wherein the adhesive or the lacquer cannot be dissolved in machine lubricant.

* * * * *